US010054032B2

(12) United States Patent
Sirovatka et al.

(10) Patent No.: US 10,054,032 B2
(45) Date of Patent: Aug. 21, 2018

(54) THERMAL MANAGEMENT SYSTEM AND METHOD OF THERMAL MANAGEMENT DURING TRANSMISSION CALIBRATION

(71) Applicant: Caterpillar Inc., Peoria, IL (US)

(72) Inventors: Matthew James Sirovatka, Aurora, IL (US); Matthew Scott Good, Sandwich, IL (US); Eric Wade Cler, Oswego, IL (US)

(73) Assignee: Caterpillar Inc., Deerfield, IL (US)

( * ) Notice: Subject to any disclaimer, the term of this patent is extended or adjusted under 35 U.S.C. 154(b) by 507 days.

(21) Appl. No.: 14/803,917

(22) Filed: Jul. 20, 2015

(65) Prior Publication Data

US 2017/0022877 A1 Jan. 26, 2017

(51) Int. Cl.
*F01P 7/04* (2006.01)
*F01P 11/14* (2006.01)

(52) U.S. Cl.
CPC ..... *F01P 7/04* (2013.01); *F01P 11/14* (2013.01); *F01P 2060/045* (2013.01)

(58) Field of Classification Search
CPC ..... F01P 1/00; F01P 7/02; F01P 7/04; F01P 11/08; F01P 11/14; F01P 2060/045; G01M 15/04; G01M 13/02
USPC ..... 73/115.02
See application file for complete search history.

(56) References Cited

U.S. PATENT DOCUMENTS

| | | | | |
|---|---|---|---|---|
| 6,453,853 | B1 * | 9/2002 | Hawkins | F01P 7/044 123/41.12 |
| 6,571,751 | B2 * | 6/2003 | Vogt | F01P 7/044 123/41.12 |
| 6,591,174 | B2 * | 7/2003 | Chung | F01P 7/048 123/41.12 |
| 6,772,714 | B2 | 8/2004 | Laird et al. | |
| 7,407,046 | B2 | 8/2008 | Bhat et al. | |
| 7,863,839 | B2 | 1/2011 | Schuricht et al. | |
| 8,160,800 | B2 * | 4/2012 | Hawkins | F01P 7/08 123/179.4 |
| 8,448,505 | B2 * | 5/2013 | Sennhenn | G01M 15/02 73/116.05 |
| 8,714,116 | B2 | 5/2014 | Hartman et al. | |
| 8,739,564 | B2 * | 6/2014 | Major | B60H 1/00807 62/177 |
| 8,825,284 | B2 | 9/2014 | Vawter et al. | |

* cited by examiner

*Primary Examiner* — Grant Moubry
(74) *Attorney, Agent, or Firm* — Miller, Matthias & Hull

(57) ABSTRACT

A controller-implemented method for controlling a fan drive of a machine having a transmission is provided. The controller-implemented method may include generating a default fan speed for controlling the fan drive based on one or more operating conditions associated with the machine, generating an override fan speed based on one or more operating conditions associated with the transmission, and controlling the fan drive according to the override fan speed at least partially during calibration of the transmission.

20 Claims, 4 Drawing Sheets

THERMAL MANAGEMENT SYSTEM AND METHOD OF THERMAL MANAGEMENT DURING TRANSMISSION CALIBRATION

TECHNICAL FIELD

The present disclosure relates generally to thermal management techniques, and more particularly, to systems and methods for managing fan drive controls during transmission calibrations.

BACKGROUND

Mobile machines, such as on-highway or off-highway vehicles, excavating machines, aircrafts, marine vessels, and locomotives, as well as stationary machines, such as engines, generators, motors, and electronic appliances, typically generate a substantial amount of heat during operation. The heat, if not properly managed, can reduce fuel efficiency and/or cause premature wear or damage to machine components. As such, machines typically implement cooling systems to divert the heat away from the machine during operation. These cooling systems may include, among other things, a cooling fan configured to draw heat away from and/or push cooler airflow toward machine components.

Due to varying environmental conditions, cooling fans are often operated at variable speeds to provide variable cooling rates. For example, an off-highway truck hauling a heavy load up a steep incline in high ambient temperatures may require a higher rate of cooling than if the truck were stationary and idling with little to no load under cooler conditions. To the extent it may be necessary and/or efficient to run the cooling fan at a high speed under the former instance, it may be unnecessary and inefficient to run the fan at the same high speed under the latter instance. Although many conventional cooling systems provide some form of variable fan speed control for different conditions, there are still some conditions that are overlooked and not appropriately accounted for.

One such condition involves transmission calibrations. The transmission of a machine typically includes hydraulic clutches that are used to shift between different input/output gear ratios within the transmission. Such transmissions also often include two input shafts and one output shaft, as well as one or more trains of interrelated gear elements that selectively couple the input shafts to the output shaft. Shifting from one gear ratio to another normally involves releasing or disengaging off-going clutches associated with the current gear ratio and applying or engaging oncoming clutches associated with the desired gear ratio. Furthermore, each clutch may be controlled via electrically controlled solenoid valves which control the fluid pressure to the clutch and hence the clutch movement.

The clutches within a transmission are generally controlled with respect to the engagement force of individual clutches, as well as the phase between clutch activations, or the phase between releasing an off-going clutch and activating an oncoming clutch. The force and phase with which the transmission clutches are manipulated greatly impact the resulting shift quality. For example, if an off-going clutch disengages prematurely, the engine speed may surge momentarily before torque is transferred, which can cause an abrasive shift and accelerated wear on machine components. Alternatively, an oncoming clutch which engages prematurely can cause a suboptimal shift and accelerated wear on the clutch or other machine components. The force and phase of each clutch are therefore occasionally calibrated in order to maintain efficiency and service life of the machine and the transmission.

In comparison to normal operating conditions, a typical calibration routine operates the transmission and the overall machine at low or negligible load levels. Correspondingly, the machine generates much less heat during a transmission calibration than it would otherwise generate under normal loads during normal machine operations. However, being unable to distinguish between normal machine operations and a calibration routine, conventional cooling schemes will proceed to cool the machine at relatively higher cooling rates according to normal operating standards despite the low cooling demand of transmission calibrations. As a result, transmission fluids are often overcooled to temperatures that are below the acceptable range, and the transmission cannot be properly calibrated accurately or efficiently.

Some conventional cooling systems offer variable cooling rates to adjust for special circumstances which may occur during operation of a machine. For example, U.S. Pat. No. 8,714,116 ("Hartman"), discloses a fan speed control system which lowers fan speed to minimize speed differentials between a fan and a fan drive. The system in Hartman, however, does not protect against overcooling conditions and does not modify fan speeds in response to a transmission calibrations or other low load and low temperature operations. Moreover, Hartman does not provide overriding cooling schemes that can be selectively enabled or disabled based on the various operating conditions of the machine and/or the transmission.

In view of the foregoing inefficiencies and disadvantages associated with conventional cooling systems, a need exists for more intuitive thermal management systems and methods which protect against not only overheating conditions, but also overcooling conditions. Moreover, a need exists for thermal management systems and methods which can override conventional or default cooling schemes during low load and low temperature operations which are susceptible to overcooling.

SUMMARY OF THE DISCLOSURE

In one aspect of the present disclosure, a controller-implemented method for controlling a fan drive of a machine having a transmission is provided. The controller-implemented method may include generating a default fan speed for controlling the fan drive based on one or more operating conditions associated with the machine, generating an override fan speed based on one or more operating conditions associated with the transmission, and controlling the fan drive according to the override fan speed at least partially during calibration of the transmission.

In another aspect of the present disclosure, a controller for controlling a fan drive of a machine having a transmission is provided. The controller may include a default control module, an override control module, and a selector module. The default control module may be configured to generate a default fan speed for controlling the fan drive based on one or more operating conditions associated with the machine. The override control module may be configured to generate an override fan speed based on one or more operating conditions associated with the transmission. The selector module may be configured to select the override fan speed for controlling the fan drive at least partially during calibration of the transmission.

In yet another aspect of the present disclosure, a thermal management system for a machine having a transmission is provided. The thermal management system may include a fan drive configured to operate a cooling fan, an engine control unit in electrical communication with at least the fan drive, and a transmission control unit in electrical communication with at least the engine control unit. The engine control unit may be configured to generate a default fan speed for controlling the fan drive. The transmission control unit may be configured to generate an override fan speed for controlling the fan drive. The override fan speed may be selectively enabled during calibration of the transmission and configured to override the default fan speed when enabled.

DETAILED DESCRIPTION

Figure 1:
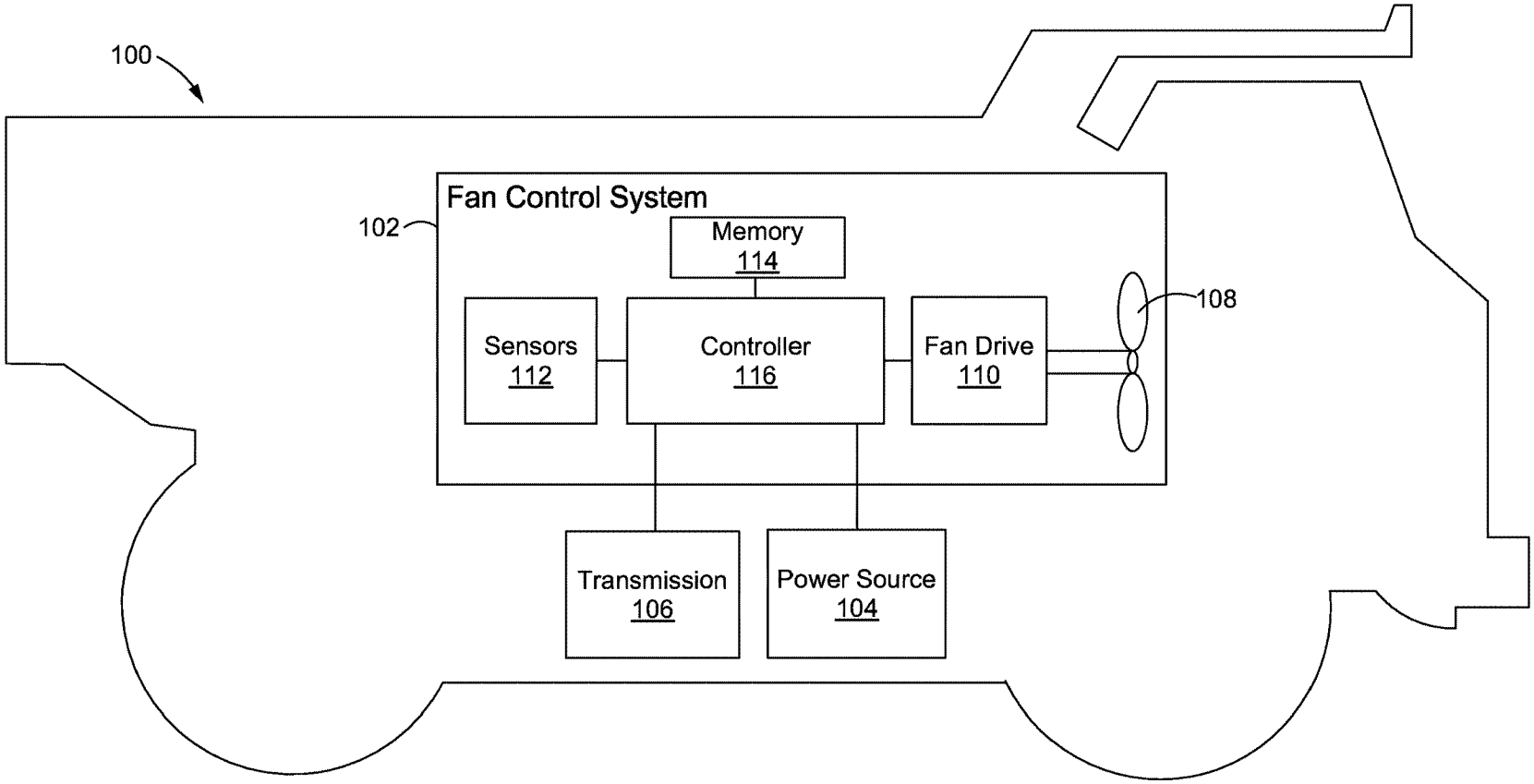
FIG. 1 is a diagrammatic illustration of a machine implementing an exemplary thermal management system of the present disclosure.

Referring now to FIG. 1, a machine 100 having an exemplary thermal management system, such as a fan control system 102, is provided. The machine 100 may include a passenger vehicle, an off-highway truck, an excavating machine, an aircraft, a marine vessel, a locomotive, an electrical generator or motor, or any other mobile or stationary machine that generates heat during operation and benefits from cooling airflow. The machine 100 may additionally include at least a power source 104, a transmission 106, and a cooling fan 108 configured to variably supply cooling airflow to the power source 104 and the transmission 106. The power source 104 may include a diesel engine, a gasoline engine, a natural gas engine, a fuel cell, a motor, or any other suitable power source for powering operations of the machine 100. The transmission 106 may include gear sets configured to convert mechanical input received from the power source 104 into mechanical output capable of driving wheels, tracks, or other traction devices. The transmission 106 may also include one or more clutches, such as hydraulic clutches, that are selectively actuatable between different gear ratios using electrically controlled solenoids, or the like.

The transmission 106 of FIG. 1 may occasionally be calibrated, or subjected to preprogrammed test routines or sequences that are used to ensure smoother gear shifts and promote the service life of the transmission 106. A typical transmission calibration routine may test the hydraulic fill rate of the individual clutches and make any adjustments necessary to ensure that the appropriate pressure is applied to the clutches. For example, a calibration routine may check and adjust for excessive hydraulic pressure, which can cause abrasive shifting and accelerate wear on the transmission 106 and other components of the machine 100. The calibration routine may also check and adjust for inadequate hydraulic pressure, which can cause shifting inefficiencies and accelerated clutch wear. Such calibration routines may be performed at the factory prior to delivery of the machine 100, or any time service work has been performed on the transmission 106 to account for new or repaired transmission components. Transmission calibrations may also be performed in the field periodically or as needed to account for any wear or degradations in the transmission components which can adversely affect the shift quality over time.

Various factors may affect the accuracy and consistency of transmission calibrations. To promote more reliable results, each calibration routine may be conducted in an environment where the transmission 106 and the machine 100 can be temporarily operated in low load and low temperature conditions. As a result, the amount of heat that is generated by the machine 100 during a transmission calibration may be substantially lower than the levels of heat typically generated under normal operating conditions. Correspondingly, applying conventional cooling schemes that are designed for normal machine operations to transmission calibrations can overcool transmission fluid temperatures to unacceptable levels, and further, result in inaccurate or failed calibrations. Inaccurate transmission calibrations can have adverse effects on the machine or the transmission, which can further affect productivity and work efficiency. Failed transmission calibrations can extend downtime and also hinder productivity. In order to prevent overcooling and inaccurate or failed calibrations, the machine 100 may implement a cooling scheme that can adjust or override default cooling schemes for the purposes of calibrating transmissions or performing other low load and low temperature operations.

The fan control system 102 of FIG. 1 may be configured to implement such a cooling scheme. As shown, the fan control system 102 may generally include a fan drive 110, one or more sensors 112, a memory 114, and a controller 116 in electrical communication with each of the power source 104, transmission 106, fan drive 110, sensors 112 and the memory 114. In particular, the fan drive 110 may be configured to operate the cooling fan 108 and variably control the fan speed based on instructions provided by the controller 116. The sensors 112 may be configured to detect or derive one or more of the actual fan speed, the engine coolant temperature, the transmission oil temperature, the after-cooler air temperature, the hydraulic oil temperature, the calibration status, and any other parameter or operating condition that may be used to gauge the cooling needs of the machine 100. The memory 114 may be provided on-board the controller 116, external to the controller 116, or otherwise in communication therewith, and configured to retrievably store one or more fan control algorithms, preprogrammed maps or look-up tables, and the like. The memory 114 may include non-transitory computer-readable medium or memory, such as a disc drive, flash drive, optical memory, read-only memory (ROM), or the like.

In general, the controller 116 of FIG. 1 may be configured to adjust or override, not only the fan speed, but also the cooling scheme that is implemented based on one or more operating conditions associated with the machine 100 and/or the transmission 106. The controller 116 may be preprogrammed to determine when a calibration is being performed, and operate the cooling fan 108 at reduced fan speeds according to a modified cooling scheme stored within the memory 114 to protect against overcooling. The controller 116 may also be preprogrammed to monitor feedback provided by one or more of the power source 104, transmission 106, cooling fan, 108, sensors 112, and the like, for any substantial increases in temperature which may occur during calibration. If necessary, the controller 116 may increase the fan speed by reverting to a default cooling scheme designed for normal machine operations to protect against overheating. The controller 116 may be implemented, for example, using any one or more of a processor, a microprocessor, a microcontroller, or any other programmable device that is suited to execute the instructions or algorithms stored within the memory 114. Furthermore, although the fan control system 102 in FIG. 1 is shown with a single controller 116, the fan control system 102 may alternatively be implemented using any suitable arrangement of two or more dedicated controllers collectively programmed to function in substantially the same manner as the single controller 116 shown.

Figure 2:
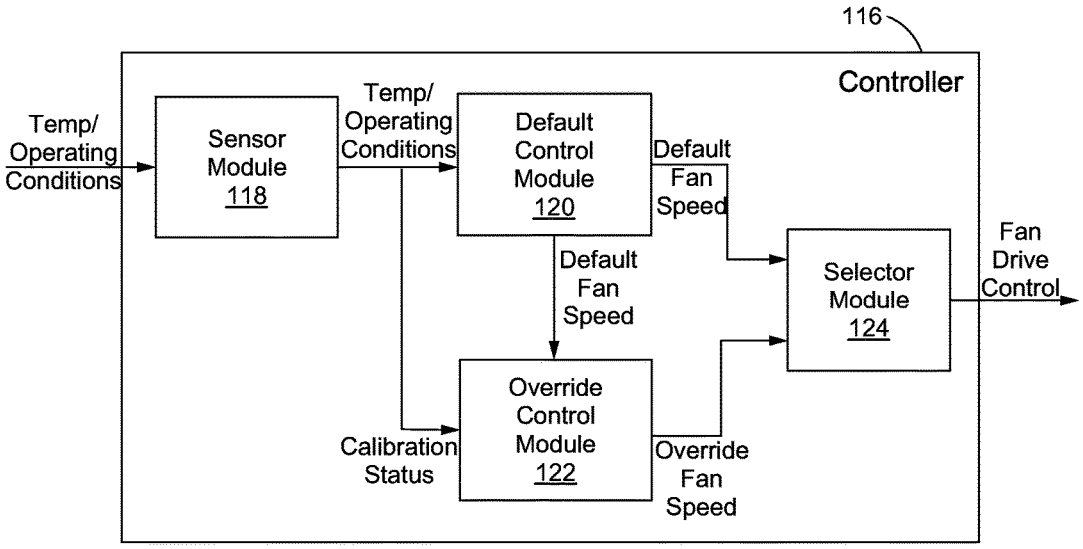
FIG. 2 is a diagrammatic illustration of an exemplary controller that may be used by the thermal management system of FIG. 1.

Turning to FIG. 2, one exemplary embodiment of a controller 116 that may be used in conjunction with the fan control system 102 of FIG. 1 is provided. For example, the controller 116 may be preprogrammed according to one or more algorithms that are generally be categorized into a sensor module 118, a default control module 120, an override control module 122, and a selector module 124. The sensor module 118 may be configured to electrically communicate with one or more sensors 112 that are disposed within the machine 100 and configured to detect one or more operating conditions associated with the machine 100 and the transmission 106. For example, the operating conditions detected by or input to the sensor module 118 may include one or more of an actual fan speed, an engine coolant temperature, a transmission oil temperature, an after-cooler air temperature, a hydraulic oil temperature, and the like. The sensor module 118 may additionally be configured to determine a calibration status, for example, whether a calibration has been requested, whether a calibration is currently in progress, whether a calibration has ended, or the like. Based on feedback from the sensors 112, the sensor module 118 may be configured to communicate one or more operating conditions of the machine 100 and/or the transmission 106 to the default control module 120, and optionally, to the override control module 122.

Figure 3:
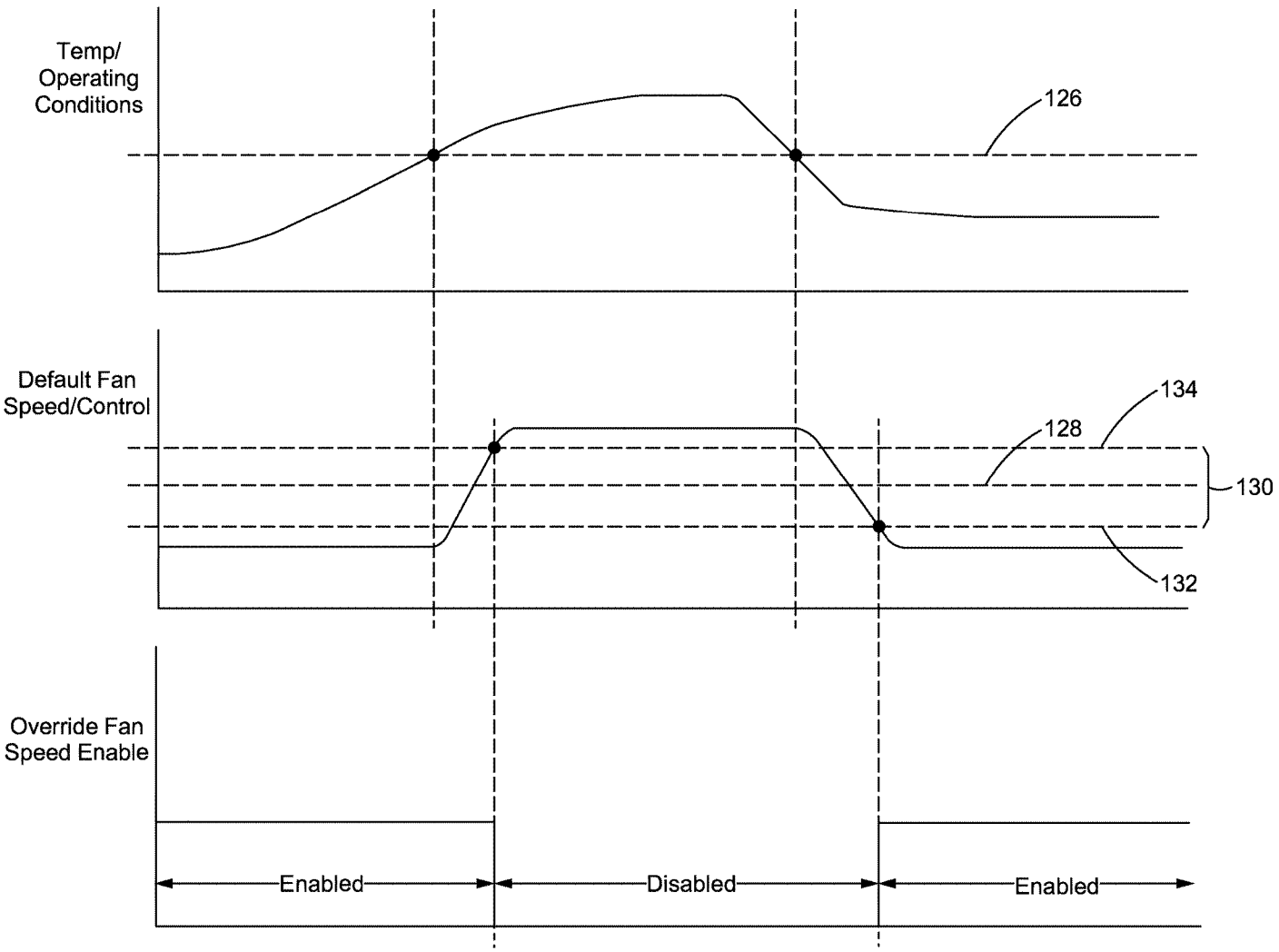
FIG. 3 is a graphical illustration of exemplary set of temperature inputs, default fan speeds and override fan control signals of the present disclosure.

Based on the operating conditions associated with the machine 100 and/or the transmission 106, the default control module 120 of FIG. 2 may be configured to generate a default fan speed, or an electrical signal corresponding thereto, for controlling the fan drive 110. The default control module 120 may determine the default fan speed based on preprogrammed fan control algorithms, maps or look-up tables, which correspond to a conventional cooling scheme designed for normal machine operations. As illustrated in FIG. 3, for example, the default control module 120 may observe one or more of the temperatures associated with the machine 100 relative to a predefined temperature threshold 126, and increase the default fan speed when the temperatures exceed the temperature threshold 126. In other embodiments, the default control module 120 may generate the default fan speed based on other operating conditions or metrics. The default control module 120 may also determine the default fan speed using techniques other than threshold comparisons. For example, the default control module 120 may configure the default fan speed to be substantially proportional to the temperature inputs. Once the default fan speed has been determined, the default control module 120 may communicate the default fan speed to each of the override control module 122 and the selector module 124.

The override control module 122 of FIG. 2 may determine whether a transmission calibration is in progress based on a calibration status indicator, or based on other operating conditions associated with the transmission 106. If a transmission calibration is in progress, the override control module 122 may generate an override fan speed, or an electrical signal corresponding thereto, that operates the fan drive 110 at a lower cooling rate than that of the default fan speed. For instance, the override fan speed may be a predefined fixed value that is retrievably stored in memory 114, and configured to provide adequate cooling for typical transmission calibrations or other low load and low temperature operations. However, the override fan speed may provide inadequate cooling for normal machine operations or other operations that demand more cooling. Thus, the override control module 122 may be configured to track and compare the default fan speed to at least one predefined speed threshold to identify substantial increases in cooling demand. Based on the comparison, the override control module 122 may selectively disable the override fan speed, and thereby selectively enable the default fan speed for situations demanding higher cooling rates. In other embodiments, the override fan speed may be adjusted or selected between two or more fixed values stored in memory 114, or otherwise derived from one or more preprogrammed maps or look-up tables stored in memory 114. In further embodiments, the override fan speed may be proportional to the default fan speed rather than fixed or discrete.

As demonstrated in FIG. 3, default fan speeds residing below the speed threshold 128 may indicate low heat generation or low cooling demands, which may further indicate susceptibility to overcooling if default fan speeds are applied or maintained. Under such conditions, the override control module 122 may generate or enable override fan speeds to reduce the amount of cooling rate. Alternatively, default fan speeds exceeding the speed threshold 128 may indicate high heat generation and high cooling demands, which may further indicate susceptibility to overheating if override fan speeds are applied or maintained. When this occurs, the override control module 122 may disable override fan speeds and allow default fan speeds to increase the cooling rate. As also illustrated in FIG. 3, the override control module 122 may compare the default fan speed to a predefined speed threshold 128, that is defined by a hysteresis band 130 extending between a lower speed threshold 132 and an upper speed threshold 134. As in the example shown, the override fan speed may remain enabled so long as the default fan speed remains below the upper threshold 134, and the override fan speed may remain disabled so long as the default fan speed remains above the lower speed threshold 132.

The selector module 124 of FIG. 2 may be configured to receive each of the default fan speed provided by the default control module 120 and the override fan speed provided by the override control module 122, and control the fan drive 110 according to one of the default fan speed and the override fan speed during calibration. By default, the selector module 124 may be configured to control the fan drive 110 according to the default fan speed. During a calibration routine, however, the selector module 124 may selectively override the default fan speed with the override fan speed supplied by the override control module 122. In one possible arrangement, the override control module 122 may continuously communicate the override fan speed to the selector module 124 throughout the calibration routine, while the selector module 124 determines when to enable the override fan speed and override the default fan speed. In another possible arrangement, the override fan speed may be selectively enabled by the override control module 122 based on observed changes in the default fan speed, while the selector module 124 automatically overrides the default fan speed whenever the override fan speed is enabled.

Figure 4:
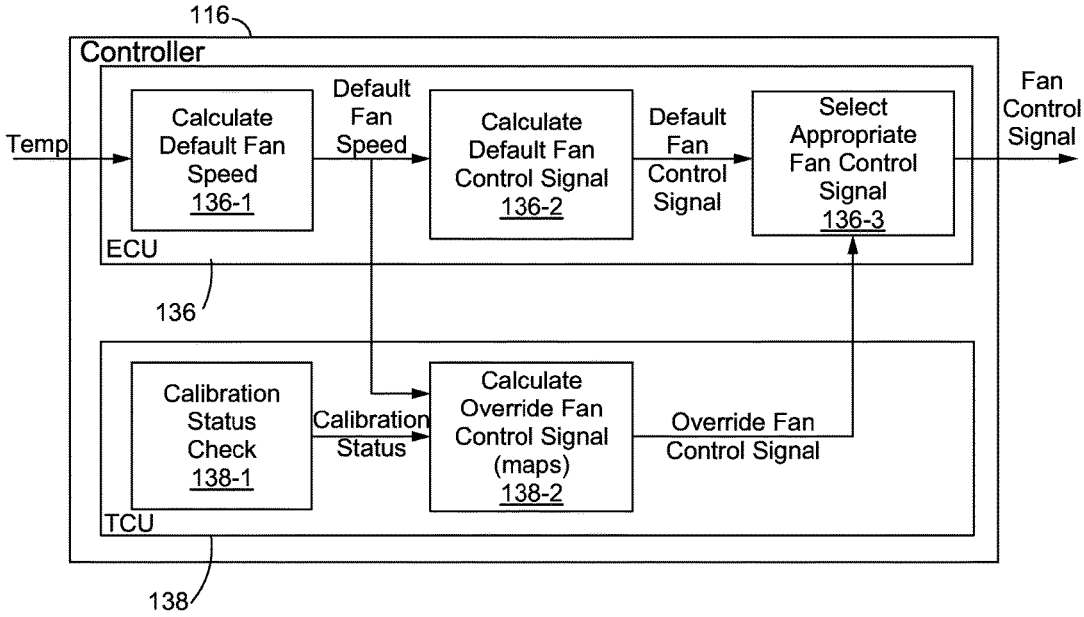
FIG. 4 is a diagrammatic illustration of another exemplary controller that may be used by the thermal management system of FIG. 1.

Referring now to FIG. 4, one exemplary implementation of the controller 116 of FIG. 2 is provided. For example, the controller 116 may be implemented according to one or more algorithms generally categorized into an engine control unit (ECU) 136 and a transmission control unit (TCU) 138. Alternatively, the controller 116 may be implemented using two or more controllers, such as at least one dedicated controller programmed to function as the ECU 136, and at least one dedicated controller programmed to function as the TCU 138. As shown, block 136-1 of the ECU 136 may initially receive one or more temperature readings or other operating conditions detected or derived by various sensors 112 positioned within the machine 100. Correspondingly, block 136-1 may calculate a default fan speed that provides a cooling rate that is appropriate for the given temperatures and operating conditions. Based on the default fan speed, block 136-2 may further calculate the corresponding default fan control signal, or the solenoid current signal needed to operate the fan drive 110 and the cooling fan 108 at the selected default fan speed. Furthermore, block 136-3 of FIG. 4 may receive the default fan control signal, and apply the default fan control signal to the fan drive 110 so long as an override control signal is not enabled.

In the TCU 138 of FIG. 4, block 138-1 may be configured to monitor the calibration status of the transmission 106. For example, block 138-1 may determine the calibration status based on a calibration status indicator or based on derivations from other operating conditions accessible by the ECU 136 and/or the TCU 138. If a calibration is in progress, block 138-2 may be configured to calculate an override fan control signal, similar to the override fan speed generated by the override control module 122 of FIG. 2. Moreover, the override fan control signal may correspond to the solenoid current signal necessary for controlling the fan drive 110 at a reduced cooling rate in comparison to that of the default fan control signal. Block 138-2 may also continue tracking or monitoring for changes in the default fan speed calculated by block 136-1, and calculate corresponding changes to the override fan control signal based thereon. The override fan control signal may be calculated based on preprogrammed fan control algorithms, or determined by reference to predefined maps or look-up tables stored in memory 114. Furthermore, block 138-2 may communicate the override fan control signal to block 136-3 of the ECU 136. Upon receiving the override fan control signal, block 136-3 of the ECU 136 may automatically override the default fan control signal and apply the override fan control signal to the fan drive 110. Block 136-3 may continue applying the override fan control signal until block 138-1 indicates that the calibration is complete or until block 138-2 disables the override fan control signal.

In other modifications, the override fan speed or the corresponding override fan control signal may be determined by the ECU 136 rather than by the TCU 138. In further modifications, one or more functions of the controller 116, such as determining when to apply or enable the override fan speed, may be incorporated within the fan drive 110. Still further variations and modifications to the algorithms or methods employed to operate the controller 116 and/or the fan control system 102 disclosed herein will be apparent to those of ordinary skill in the art. One exemplary algorithm or method by which the controller 116 may be operated to control a fan drive 110 of a machine 100 during transmission calibration routines is discussed in more detail below.

INDUSTRIAL APPLICABILITY

In general terms, the present disclosure sets forth thermal management systems and methods that account for machine calibrations and other low load and low temperature conditions where overcooling is a concern. Although applicable to any type of mobile or stationary machine, the present disclosure may be particularly applicable to off-highway vehicles or excavating machines, which have the capacity to operate under heavy loads and within high ambient temperatures, but occasionally operate under low loads and within low ambient temperatures. The present disclosure generally provides means for determining when calibrations are performed, and overriding conventional cooling schemes with modified cooling schemes designed for lower cooling rates during calibrations. By reducing the cooling rate during transmission calibrations, transmission fluid temperatures are more consistently maintained within acceptable levels. Furthermore, by maintaining more consistent transmission fluid temperatures, calibrations are more efficiently conducted and overall productivity is improved.

Figure 5:
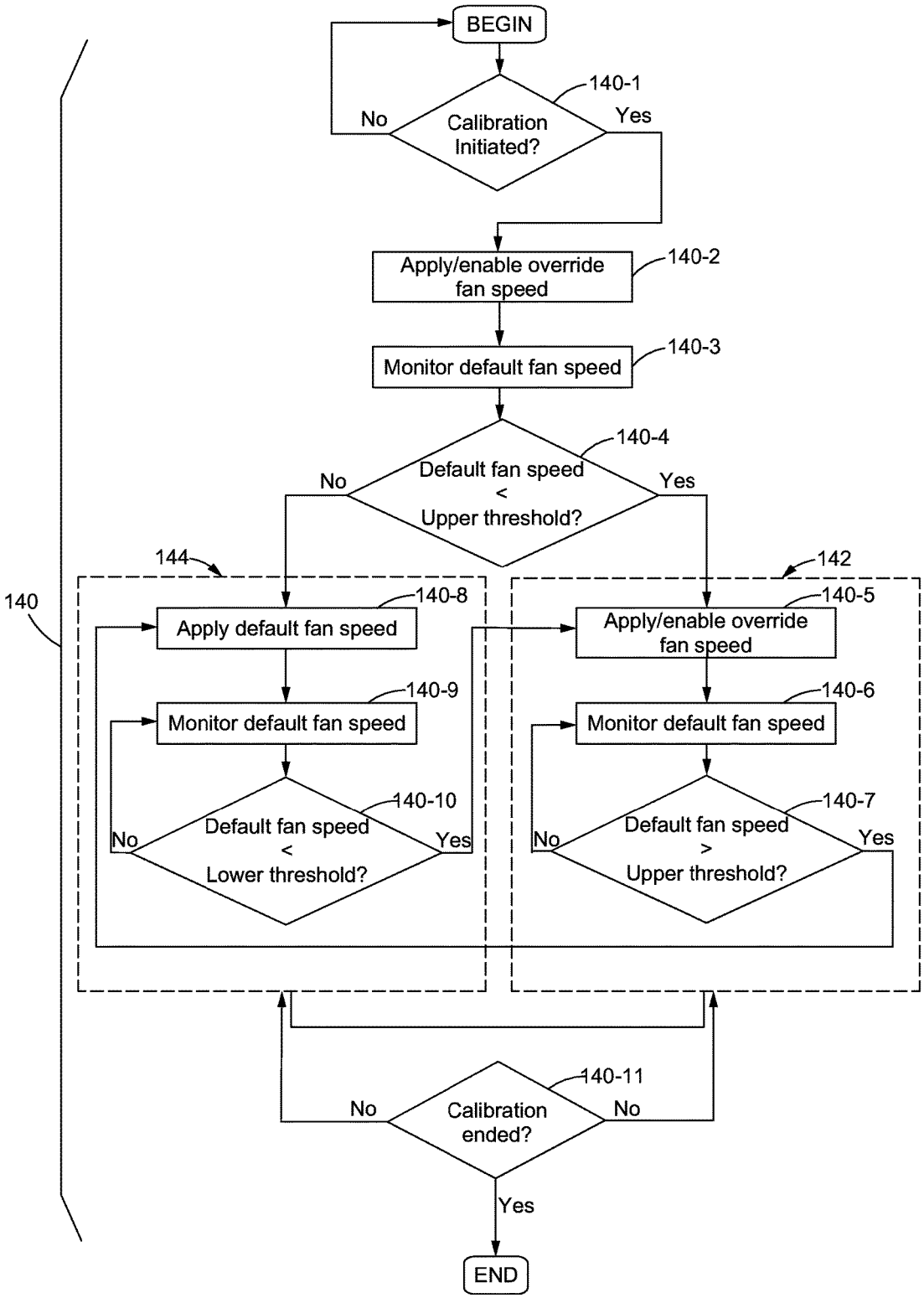
FIG. 5 is a flowchart depicting an exemplary disclosed method that may be performed by a controller of the present disclosure.

One exemplary algorithm or controller-implemented method 140 for controlling a fan drive 110 of a machine 100 during transmission calibrations is diagrammatically provided in FIG. 5. As shown in block 140-1 of FIG. 5, the controller 116 may initially determine whether a calibration request has been received and/or whether a calibration has been initiated. If no calibration request has been received, the controller 116 may continue monitoring for a new calibration request, and maintain control of the fan drive 110 according to more conventional cooling schemes. For instance, the controller 116 may continue controlling the fan drive 110 according to a default fan speed or a corresponding default fan control signal, such as those generated by the default control module 120 of FIG. 2 or the ECU 136 of FIG. 4. If a calibration has been initiated, the controller 116 in block 140-2 may override the default fan speed with an override fan speed that is designed to reduce the cooling rate of the fan drive 110 for calibration purposes. More specifically, the controller 116 may apply or enable an override fan speed or a corresponding override fan control signal, such as those generated by the override control module 122 of FIG. 2 or the TCU 138 of FIG. 4.

In block 140-3 of FIG. 5, the controller 116 may continue monitoring the default fan speed for any indications of overheating which may occur during the calibration. More particularly, as shown in FIG. 3, the controller 116 may compare the default fan speed to predefined speed thresholds 132, 134 to determine when the reduced cooling rate of the override fan speed is appropriate, and when the override fan speed may be inadequate for the observed cooling demands. For example, in block 140-4, the controller 116 may determine whether the default fan speed is less than the upper speed threshold 134. If the default fan speed remains to be less than the upper speed threshold 134, the controller 116 in block 140-5 may continue applying or enabling the override fan speed to the fan drive 110. Additionally, the controller 116 may also continue monitoring the default fan speed in block 140-6, and determine whether the default fan speed exceeds the upper speed threshold 134 in block 140-7. As shown in FIG. 5 and as further illustrated in FIG. 3, the controller 116 remains in the override state 142 so long as the default fan speed remains less than the upper speed threshold 134 and so long as the calibration remains in progress.

If, however, the default fan speed is greater than the upper speed threshold 134 in either of block 140-4 or block 140-7, the controller 116 determines that the machine 100 is generating more heat than the override fan speed is able to dissipate and reverts back to the default fan speed as shown in block 140-8 of FIG. 5. More specifically, the controller 116 may at least temporarily disable the override fan speed and apply the default fan speed to the fan drive 110. As the default fan speed is applied, the controller 116 in block 140-9 may continue monitoring for any decreases in the default fan speed, which may be indicative of decreases in the operating temperatures of the machine 100 and/or the transmission 106. As shown in block 140-10 and as further illustrated in FIG. 3, the controller 116 remains in this default state 144 so long as the default fan speed exceeds the lower speed threshold 132 and so long as the calibration remains in progress. If the default fan speed falls below the lower speed threshold 132, the controller 116 may proceed or return to the override state 142 and block 140-5 of FIG. 5.

Furthermore, during either the override state 142 or the default sate 144 of FIG. 5, the controller 116 in block 140-11 may be configured to monitor the calibration status to determine whether calibration of the transmission 106 has ended. As shown, the controller 116 may remain in either the override state 142 or the default state 144 so long as the calibration is in progress. However, once the calibration is complete, the controller 116 may automatically disable all override fan speeds, and revert to default fan speeds and default fan control signals. The controller 116 may additionally return to block 140-1 to standby for the next calibration request.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A controller-implemented method for controlling a fan drive of a machine having a transmission, comprising:

generating a default fan speed for controlling the fan drive based on one or more operating conditions associated with the machine;

generating an override fan speed based on one or more operating conditions associated with the transmission; and controlling the fan drive according to the override fan speed at least partially during calibration of the transmission.

2. The controller-implemented method of claim 1, wherein the one or more operating conditions associated with the machine and the one or more operating conditions associated with the transmission include one or more of an actual fan speed, an engine coolant temperature, a transmission oil temperature, an after-cooler air temperature, a hydraulic oil temperature, and a calibration status indicator.

3. The controller-implemented method of claim 1, wherein the override fan speed is generated during calibration of the transmission and configured to be less than the default fan speed.

4. The controller-implemented method of claim 1, wherein the override fan speed is adjusted based on changes in the default fan speed and one or more preprogrammed maps retrievably stored in a memory.

5. The controller-implemented method of claim 1, further comprising:

tracking the default fan speed relative to at least one predefined threshold;

controlling the fan drive according to the override fan speed when the default fan speed is less than the at least one predefined threshold; and controlling the fan drive according to the default fan speed when the default fan speed is greater than the at least one predefined threshold.

6. The controller-implemented method of claim 5, wherein the at least one predefined threshold includes a hysteresis band extending between a lower threshold and an upper threshold, the fan drive being controlled according to the override fan speed until the default fan speed exceeds the upper threshold, and the fan drive being controlled according to the default fan speed until the default fan speed falls below the lower threshold.

7. The controller-implemented method of claim 1, wherein the fan drive is initially controlled according to the override fan speed upon receiving a calibration request.

8. The controller-implemented method of claim 1, wherein the fan drive is controlled according to the default fan speed and the override fan speed is disabled when calibration of the transmission is complete.

9. A controller for controlling a fan drive of a machine having a transmission, comprising:

a default control module configured to generate a default fan speed for controlling the fan drive based on one or more operating conditions associated with the machine;

an override control module configured to generate an override fan speed based on one or more operating conditions associated with the transmission; and a selector module configured to select the override fan speed for controlling the fan drive at least partially during calibration of the transmission.

10. The controller of claim 9, further comprising a sensor module configured to determine the one or more operating conditions associated with the machine and the one or more operating conditions associated with the transmission based on one or more sensors configured to detect one or more of an actual fan speed, an engine coolant temperature, a transmission oil temperature, an after-cooler air temperature, a hydraulic oil temperature, and a calibration status indicator.

11. The controller of claim 9, wherein the override control module is configured to generate the override fan speed to be less than the default fan speed.

12. The controller of claim 9, wherein the override control module is configured to adjust the override fan speed based on changes in the default fan speed and one or more preprogrammed maps retrievably stored in a memory.

13. The controller of claim 9, wherein the override control module is configured to track the default fan speed relative to at least one predefined threshold, the selector module being configured to select the override fan speed for controlling the fan drive when the default fan speed is less than the at least one predefined threshold, and select the default fan speed for controlling the fan drive when the default fan speed is greater than the at least one predefined threshold.

14. The controller of claim 13, wherein the at least one predefined threshold includes a hysteresis band extending between a lower threshold and an upper threshold, the selector module being configured to select the override fan speed until the default fan speed exceeds the upper threshold, and select the default fan speed until the default fan speed falls below the lower threshold.

15. A thermal management system for a machine having a transmission, comprising:

a fan drive configured to operate a cooling fan;

an engine control unit in electrical communication with at least the fan drive and configured to generate a default fan speed for controlling the fan drive; and a transmission control unit in electrical communication with at least the engine control unit and configured to generate an override fan speed for controlling the fan drive that is selectively enabled during calibration of the transmission, the override fan speed being configured to override the default fan speed when enabled.

16. The thermal management system of claim 15, wherein the engine control unit is configured to generate the default fan speed based on one or more of an actual fan speed, an engine coolant temperature, a transmission oil temperature, an after-cooler air temperature, a hydraulic oil temperature, and a calibration status indicator.

17. The thermal management system of claim 15, wherein the transmission control unit is configured to generate the override fan speed to be less than the default fan speed.

18. The thermal management system of claim 15, wherein the transmission control unit is configured to adjust the override fan speed based on changes in the default fan speed and one or more preprogrammed maps retrievably stored in a memory.

19. The thermal management system of claim 15, wherein the transmission control unit is configured to track the default fan speed relative to at least one predefined threshold, enable the override fan speed when the default fan speed is less than the at least one predefined threshold, and disable the override fan speed when the default fan speed is greater than the at least one predefined threshold.

20. The thermal management system of claim 19, wherein the at least one predefined threshold includes a hysteresis band extending between a lower threshold and an upper threshold, the transmission control unit being configured to enable the override fan speed until the default fan speed exceeds the upper threshold, and disable the override fan speed until the default fan speed falls below the lower threshold.

* * * * *